United States Patent [19]

Klein

[11] Patent Number: 4,618,301

[45] Date of Patent: Oct. 21, 1986

[54] CONICAL CAN END WITH PUSH DOWN GATE

[76] Inventor: Gerald B. Klein, 13451 Stuart Ct., Broomfield, Colo. 80020

[21] Appl. No.: 166,968

[22] Filed: Jul. 8, 1980

Related U.S. Application Data

[62] Division of Ser. No. 63,794, Aug. 6, 1979, Pat. No. 4,244,490.

[51] Int. Cl.[4] ..... B21D 51/26

[52] U.S. Cl. ..... 413/8; 156/69; 413/18; 413/60

[58] Field of Search ..... 427/234, 241, 284; 220/268; 113/1 E, 1 F, 120 XY, 121 C, 121 D; 156/69; 413/7, 8, 18, 20, 60, 61

[56] References Cited

U.S. PATENT DOCUMENTS

| | | | |
|---|---|---|---|
| 3,852,095 | 12/1974 | Hogstrom | 427/284 |
| 3,859,113 | 1/1975 | Horvath et al. | 427/284 X |
| 3,980,200 | 9/1976 | Klein | 220/268 |
| 4,124,411 | 11/1978 | Meuleman et al. | 427/241 X |
| 4,295,573 | 10/1981 | Terry et al. | 427/234 X |

*Primary Examiner*—Mark Rosenbaum

*Attorney, Agent, or Firm*—Dennis O. Kraft

[57] ABSTRACT

A conical can end wherein the central expansion panel of the end is drawn to form a conical frustum with a panel at the apex end thereof, an aperture in the apex panel, a push-down gate beneath this aperture and a short hinge means interconnecting the gate with the apex panel.

3 Claims, 9 Drawing Figures

CONICAL CAN END WITH PUSH DOWN GATE

This is a Divisional of application Ser. No. 063,794, filed Aug. 6, 1979, now U.S. Pat. No. 4,244,490 issued Jan. 13, 1981.

This invention relates to push-down gates in beverage can ends, and more particularly to a conical end having a pushdown gate at its apex.

The conical form alluded to is actually a conical frustum and the reference to the "apex" is actually to the top of the frustum. Thus, whenever the terms "conical" and "apex" are hereinafter used, in accordance with common usage, such will mean a frustum and the top or upper end thereof.

When cans began to replace bottles for dispensing beverages such as beer, cans with conical ends were used to simulate the form of a bottle. A pouring spout was formed at the apex which was closed by a conventional crown. As beverage cans became more popular, flat top ends were introduced and gradually dominated the market. Economic packaging and manufacturing factors were largely responsible for this.

In the present state of the art of can ends, pull tabs dominate the market but push tabs, hereinafter referred to as push-down gates, have been introduced and are required in a number of states because they are pushed into the can without being separated from an end, important safety and environmental factors. Reference is made to U.S. Pat. No. 3,334,775 to myself and Kenneth E. Harper, as being exemplary of a push-down gate. That construction will be hereinafter referred to as a "triple-fold-gate".

The present invention places a push-down gate, and preferably a triple-fold gate at the apex of a conical can end. Significant advantages were discovered in this construction. In the first place, the conical can end is radially symmetrical about the cylindrical can axis. This means that the can is better balanced and more stable when it is being opened. This also means that the drawing of the end is simplified because the metal will stretch in a balanced, even manner with more metal to draw from. The application of sealants to the score cuts defining the gate and vent outlines are greatly simplified. The tool manufacturing cost is considerably less than that incurred for eccentric tools and dies needed for flat-top ends. One factor is that less precision is required and tooling can be produced without the need for specialized machinery. The balanced pressures on the forming tools and dies will extend their useful life. This results in an end which is very economical to manufacture and is a very reliable product.

A second facet of the invention resides in the discovery that a simple and very effective pouring lip, functioning as an orifice, can be easily formed in connection with placing a pushdown gate at the cone apex to significantly improve the manner in which a beverage flows from the can, whether the beverage is poured from the can or whether it is drunk directly from the can.

The foregoing advantages set forth important objects of the invention. With such and other objects in view, the present invention comprises certain constructions, combinations and arrangements of parts and elements as hereinafter described, defined in the appended claims and illustrated in the accompanying drawing in which:

Figure 1:
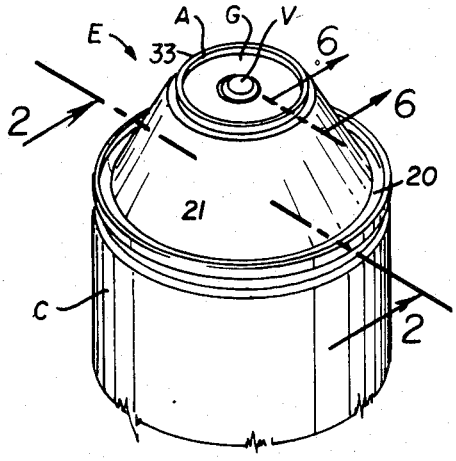
FIG. 1 is an isometric view of the upper portion of a can having my improved frusto-conical end and push-down gate thereon.
Figure 3:
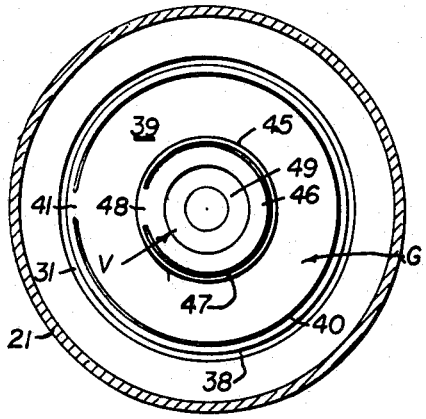
FIG. 3 is an under sectional view as taken from the indicated line 3—3 at FIG. 2.

Referring more particularly to the drawing, the can C of FIG. 1 is closed by a conical end E having a circular aperture A at its apex end and a triple-bond gate G beneath the aperture. Also, and preferably, a vent V may be formed in this gate. As heretofore mentioned, this cylindrical can C and the conical end are radially symmetrical about the cylindrical axis of the can, providing for a balanced construction which simplifies the manufacture of the end.

Figure 2:
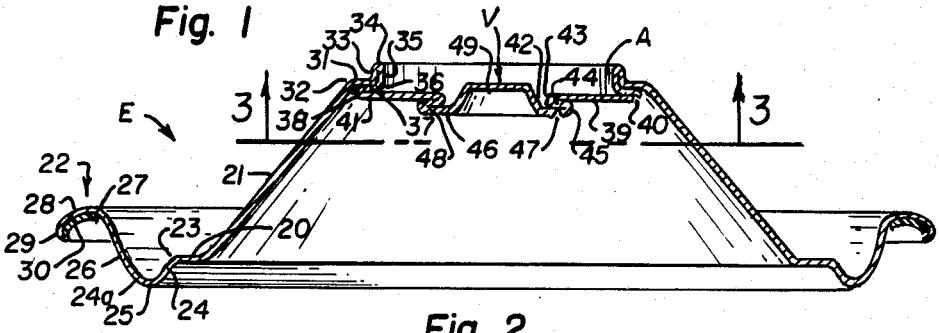
FIG. 2 is a transverse section of the can end as taken from the indicated line 2—2 at FIG. 1, but on an enlarged scale and showing the end before it is seamed onto the body of the can.

A substantial portion of this conical end is conventional, the novel features residing in the aperture and gate construction at the apex. FIG. 2 illustrates the end before it is seamed to the cylindrical wall of the can body. This end may include a flat, circular, expansion panel 20 wherein a conical frustum 21 is drawn with the base of the cone 21 being at the panel 20 and at or near its outer boundary so that the panel 20, if it exists, forms only a comparatively narrow shoulder. The panel 20 is surrounded by a peripheral seaming and strengthening radii 22 and the panel boundary is at a short downturned expansion radius 23 which turns to a chuck panel radius 24 having its bottom forming a chuck panel 25. An outward chuck panel radius **24*a* turns to an upwardly extended chuck wall 25. The upper crest of this chuck wall turns outwardly to a seaming panel radius 27 from whence a circlar seaming panel 28 outstands with the outward edge being downturned to form a curl 29. A latex seaming compound 30 is provided at the inner under portion of the seaming panel 28 to complete the peripheral radii 22 of the end. The formation of this panel 20, the wall of the cone 21 and the peripheral radii 22** are conventional and need not be further described.

The apex of the cone 21 includes a flat panel 31 wherein the aperture A and gate G are drawn so that the panel 31 forms only a narrow shoulder. Its outer boundary is a downturned radius 32 to merge into the cone 21. In the construction illustrated at FIG. 2, a short, circular, upstanding, outer lip 33 forms the inner boundary of the shoulder. The metal turns at the crest 34 of this lip as an 180-degree downward fold to form an orifice 35, the aperture A. In a standard can end this lip can be of a height which is approximately a curl 29 thickness to permit stacking and nesting as with conventional end units. An aperture lip height of approximately 0.085-inch will be a suitable maximum.

Thence, the metal is expanded and folded underneath the lip 33 to form the triple-fold gate G. This includes an outward aperture fold 36, a spacer strip 37, a reverse underfold 38 and a gate panel 39 below the spacer strip. The gate G is defined in the panel 39 by a cut or score line 40 opposite the spacer strip 37. The score line 40 extends continuously about the panel 39 except at a short hinge 41.

When the gate G is pushed downwardly into the can, it will remain attached to the can at the hinge 41. A vent V is optional for this end and will depend upon the type of beverage or liquid in the can. If the beverage is not carbonated, a vent is unnecessary. When it is used, the vent will be in the gate G, and preferably at the can axis, at the center of the gate. The vent V, illustrated at FIG. 2, is a triple-fold type, and is essentially identical to a triple-fold, pushdown gate. A vent orifice 42 is defined in the surface of the gate G by a circular aperture fold 43. A spacer strip 44 is below the gate surface and a reverse underfold 45 defines the edges of a circular vent panel 46, below the spacer strip. The vent V is defined in the panel 45 by a score line 47 which extends continuously about the panel 46 except at a short hinge portion 48. The placement of the hinge 48, with respect to the gate hinge 41, is optional. To complete the vent V, a dome 49 is drawn in the panel 46 to extend above the gate panel so it can be easily reached and opened by finger pressure.

Figure 4:
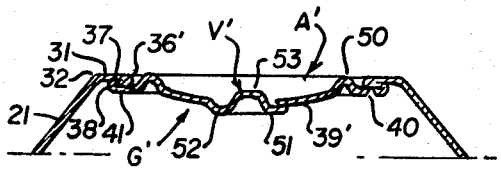
FIG. 4 is a fragmentary sectional view of a can end, similar to the upper portion of FIG. 2, but showing a modified arrangement of the top of the end and the push-down gate.

It is manifest that the gate form in the end may be varied in a number of details without departing from the invention. FIG. 4 shows a first modification of end structure E′ wherein the lip 33 is omitted and the aperture A′ is formed by an outward aperture underfold 36′ from the panel 31 and to the spacer strip 37. Thence, an underfold 38 defines a gate panel outline 39′. A modified gate panel 39′ is shown as being dished downwardly with a finger grip ridge 50 adjacent to the aperture. Also, a different type of vent V′ is shown. This vent, a conventional type, is formed by punching out a circular blank 51 to sever the blank from the gate panel 39′ except for a short hinge 52. The blank is offset to permit it to be positioned below the vent orifice in the gate. The gate blank 51 is then squeezed, as by coining, to enlarge its diameter and at the same time, a dome 53 is drawn in the blank to extend it above the gate panel 39′ where it can be easily pressed by a finger.

Figure 5:
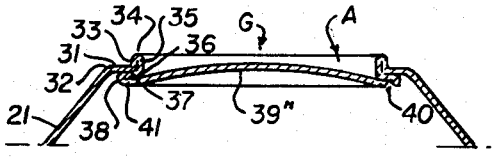
FIG. 5 is a fragmentary sectional view similar to FIG. 4, but showing another modified arrangement of the push-down gate.

The construction shown at FIG. 5 is substantially the same as that described for FIG. 2 excepting that a vent is omitted and the gate panel 39″ is convexed upwardly to provide enhanced rigidity of the gate.

Figure 6:
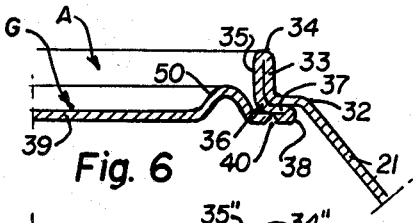
FIG. 6 is a fragmentary sectional view of a corner portion of the top of the end and gate, similar to the section shown at the indicated line 6—6 at FIG. 1, but on a greatly enlarged scale and showing another modified construction.

The construction shown at FIG. 6 is substantially the same as that described for FIG. 2, excepting that a finger grip and guard ridge 50 is added to the gate panel 39 which extends about the panel adjacent to the aperture.

Figure 7:
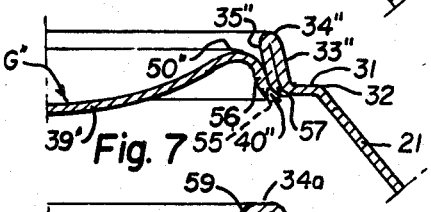
FIG. 7 is a fragmentary sectional view similar to FIG. 6, but showing yet another modified construction.

The construction shown at FIG. 7 is a further modification of a push-down gate at the apex of the cone wherein the gate is not a triple-fold type as heretofore described. In this arrangement, the panel shoulder 31 merges into the cone 21 as heretofore described, and a lip 33″ forms the inner boundary of the shoulder. This lip 33″ extends to a crest 34″ where a downward infold forms an orifice 35″. In contrast to the construction previously described, this lip and orifice are tilted inwardly to make the minimum diameter of the aperture orifice 35″ at the crest 34″. There is a simple inward fold 55 at the base of the orifice 35″ to define the gate panel 39′ which is shown as a concaved or dished member with a finger grip ridge 50″ being formed closely adjacent to and engaging the orifice wall 35″. The outer wall portion 56 of this finger grip ridge 50 is tightly fitted against the wall 35″. A score line 40″ cuts the gate panel 39″ at the fold 55 to permit the gate to be pushed downwardly into the can, and this score line extends completely about the fold 55, shown as a dotted line, except at a short hinge portion, not shown at FIG. 7. The score line cut 40″ is such that the portion at the bottom of the orifice wall 35″ is folded against the radius of the fold between the shoulder 31 and lip 33 as at 57 to eliminate the possibility of a sharp edge.

Figure 8:
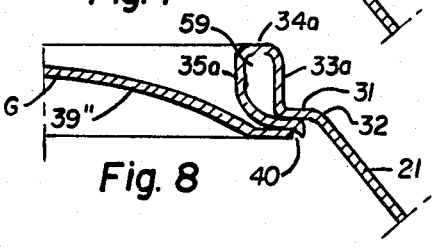
FIG. 8 is a fragmentary sectional view similar to FIG. 6, but showing yet another modified construction.

The construction at FIG. 8 is similar to the construction at FIG. 2 except that the gate panel 39′ is convexed, as at FIG. 5, and the aperture wall formed by the lip **33*a* and the orifice wall 35 is piped as at 59**. Where thin metal is used to form the end E, the piping gives a better impression of a rounded aperture which will not be responsible for an accidental cut as where the can is opened in a careless manner.

Figure 9:
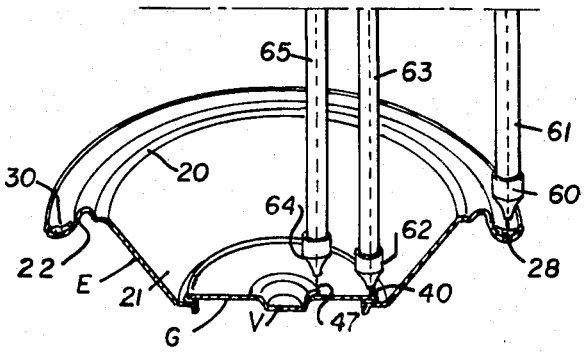
FIG. 9 is an isometric sectional view of an end similar to FIG. 2, but on a reduced scale, inverted and showing in a diagrammatic manner the application of sealant and seaming materials at several locations on the end.

There is a further advantage in forming an end which is radially symmetrical to the can axis. To complete an end, when the score line 40 or 40″ is cut through the metal and the vent is likewise cut or overlapped, both must be sealed from leaking as by a paraffin base hot melt adhesive or a plastisol, such as disclosed in U.S. Pat. Nos. 3,905,513 and 3,980,200. The application of such adhesive or plastisol may be simultaneous with the application of the latex seaming compound 30 in the seaming panel 28. FIG. 9 shows a mode for applying both the seaming compound and sealing material simultaneously. The end E is in an inverted position and rotated in any suitable manner, not shown. A nozzle 60, connected to a supply line 61, is directed to the seaming panel 28; a second nozzle 62, connected to a supply line 63, is positioned over the score line 40; and, a third nozzle 64, connected to a supply line 65, is positioned over the vent score line 47, or edge of the blank 51 in a construction such as shown at FIG. 4. These supply lines 61, 63 and 65 are fed by apparatus not shown, each with a proper feed to make proper application as the end is rotated.

An alternate mode of providing the sealing material is to apply a small amount at the center of the end in a globate form and in a liquid state. The rapidly rotating end permits an outward flow to the scores 47 and 48 by centrifugal action. A further advantage of this mode of application is that a dielectric coating, the sealant, covers that portion of the end most severely strained by drawing. This eliminates exposure at this critical region should the enamel coating rupture.

A single nozzle 64 may be used to apply sealing material at the vent score 47 in a quantity sufficient to permit movement of material by centrifugal action to also seal the gate score 40.

The manufacture of the ends herein described can be by conventional drawing operations with dies which can be made by skilled artisans and thus need not be described.

I have now described my invention in considerable detail. However, it is obvious that others skilled in the art can build and devise alternate and equivalent constructions which are, nevertheless, within the spirit and scope of the invention. Hence, I desire that my protection be limited, not by the constructions herein described, but only by the proper scope of the appended claims.

What is claimed is:

1. A method for sealing and coating the underside of a can end of the type having a concentrically disposed aperture with a gate therein defined by a gate panel which is cut through about a peripheral score line, said method comprising the steps of:

inverting the can end;

applying a globule of fluid sealant at the center of the underside of can end; and rotating the can end about its axis while in the inverted position to flow the globule of fluid sealant by centrifugal action outwardly from the center of the can end and into the cut through score line to seal the score line and to effect the deposit of a dielectric coating on the underside of the can end.

2. The method defined in claim 1, wherein the fluid sealant is a plastisol.

3. The method defined in claim 2, wherein the can end includes a peripheral seaming panel to receive a seaming compound, and wherein the fluid sealant and the seaming compound are applied simultaneously.

* * * * *